US007533843B2

(12) United States Patent
Caamano et al.

(10) Patent No.: US 7,533,843 B2
(45) Date of Patent: May 19, 2009

(54) RECIPROCATING MECHANISM FOR A REEL ASSEMBLY

(75) Inventors: Ray Caamano, Gilroy, CA (US); Christian Okonsky Gerard, Austin, TX (US); Daniel Francis Caputo, Lakeway, TX (US)

(73) Assignee: Great Stuff, Inc., Austin, TX (US)

( * ) Notice: Subject to any disclaimer, the term of this patent is extended or adjusted under 35 U.S.C. 154(b) by 178 days.

(21) Appl. No.: 11/420,164

(22) Filed: May 24, 2006

(65) Prior Publication Data

US 2006/0266868 A1 Nov. 30, 2006

Related U.S. Application Data

(60) Provisional application No. 60/772,455, filed on Feb. 10, 2006, provisional application No. 60/685,637, filed on May 27, 2005.

(51) Int. Cl.
*B65H 57/00* (2006.01)

(52) U.S. Cl. ..... 242/397.3

(58) Field of Classification Search ..... 242/389, 242/390, 390.8, 397, 398, 397.3, 390.9, 399, 242/399.1, 277, 280, 281, 483.5, 484, 484.1, 242/390.2; 74/54, 55, 89.14, 425
See application file for complete search history.

(56) References Cited

U.S. PATENT DOCUMENTS

| | | | |
|---|---|---|---|
| 2,494,003 | A | 1/1950 | Russ |
| 3,115,312 | A | 12/1963 | Rees |
| 3,804,350 | A | 4/1974 | Williams |
| 3,804,370 | A | 4/1974 | Woodard |
| 3,876,045 | A | 4/1975 | Knarreborg |
| 3,889,896 | A | 6/1975 | O'Hara |
| 3,997,128 | A | 12/1976 | Hara et al. |
| 4,014,422 | A | 3/1977 | Morishita |
| 4,065,065 | A | 12/1977 | Kallenborn |
| 4,456,199 | A | 6/1984 | Seibert |
| 4,513,772 | A | 4/1985 | Fisher |
| 4,570,875 | A | 2/1986 | Buluschek |
| 5,209,420 | A | 5/1993 | Simmons et al. |

(Continued)

FOREIGN PATENT DOCUMENTS

| | | |
|---|---|---|
| CA | 855578 | 11/1970 |

(Continued)

OTHER PUBLICATIONS

International Search Report for corresponding PCT Application No. PCT/US2006/019726, mailed Dec. 15, 2006.

*Primary Examiner*—Peter M Cuomo
*Assistant Examiner*—William E Dondero
(74) *Attorney, Agent, or Firm*—Knobbe Martens Olson & Bear LLP

(57) ABSTRACT

A reel assembly comprises a drum configured to rotate about a drum axis. The drum is configured to receive a linear material wrapped around a spool surface thereof as the drum rotates about the drum axis. A housing substantially encloses the drum, wherein a portion of the housing defines an aperture configured to receive the linear material therethrough. A reciprocating mechanism connects to the drum and reciprocatingly rotates the drum relative to the shell about a generally vertical axis as the drum rotates about the drum axis.

18 Claims, 15 Drawing Sheets

U.S. PATENT DOCUMENTS

| | | | | |
|---|---|---|---|---|
| 5,373,925 | A * | 12/1994 | Handford et al. | 191/12.2 A |
| 5,385,314 | A | 1/1995 | Hughes | |
| 6,279,848 | B1 | 8/2001 | Mead | |
| 6,422,500 | B2 | 7/2002 | Mead | |
| 6,981,670 | B2 | 1/2006 | Harrington | |
| 2001/0045484 | A1 | 11/2001 | Mead | |

FOREIGN PATENT DOCUMENTS

| | | | |
|---|---|---|---|
| CA | 855878 | | 11/1970 |
| DE | 100 23 448 | A1 | 11/2001 |
| EP | 0 043 368 | A2 | 1/1982 |
| GB | 1018112 | | 1/1966 |
| JP | 03111376 | | 5/1991 |
| JP | 6-100247 | | 4/1994 |
| WO | WO 91/13020 | | 9/1991 |

* cited by examiner

FIG. 9A
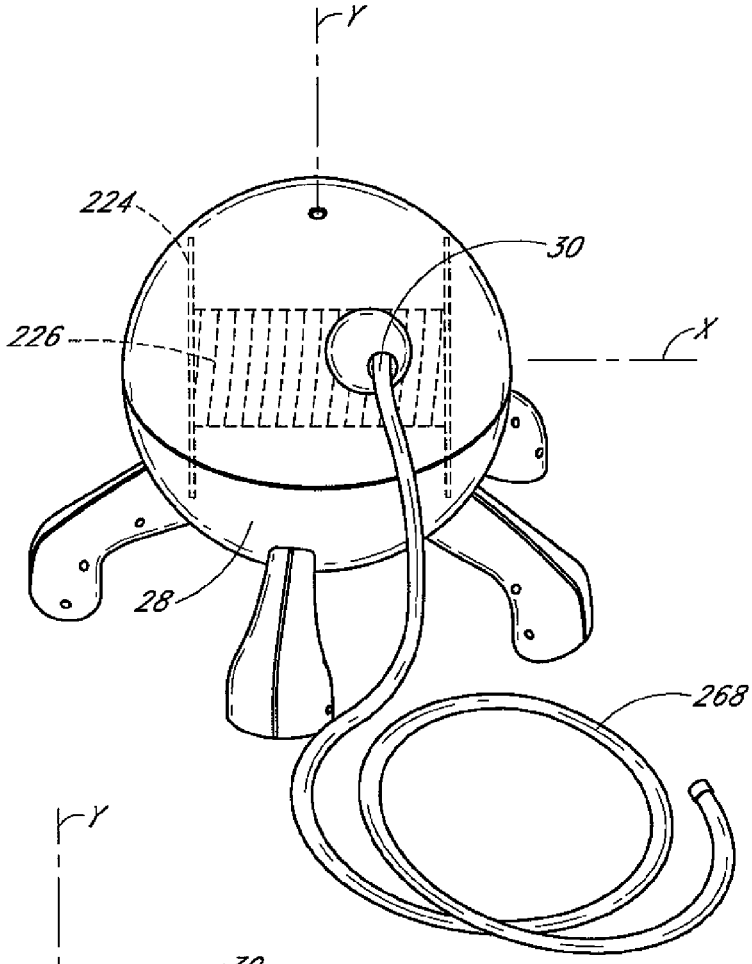
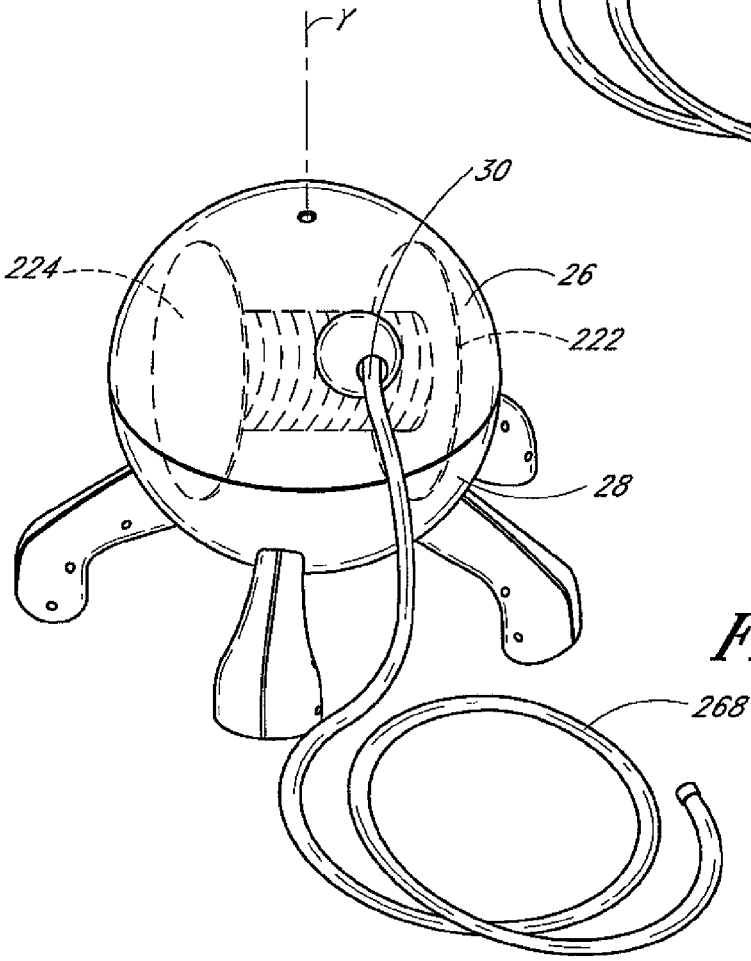
FIG. 9B

RECIPROCATING MECHANISM FOR A REEL ASSEMBLY

CROSS-REFERENCE TO RELATED APPLICATIONS

This application claims the benefit of U.S. Provisional Patent Application No. 60/685,637 filed May 27, 2005, titled Reciprocating Mechanism for a Reel Assembly, and U.S. Provisional Patent Application No. 60/772,455 filed Feb. 10, 2006, titled Reciprocating Mechanism for a Reel Assembly, the entire contents of both of which are incorporated herein by reference and should be considered a part of this specification.

BACKGROUND OF THE INVENTION

1. Field of the Invention

This invention relates generally to reels for spooling linear material and, in particular, to a reel including an improved reciprocating mechanism for distributing linear material across a rotating reel drum.

2. Description of the Related Art

Reels for spooling linear material, such as a hose or wire, onto a rotating drum have incorporated reciprocating motion of a guide through which the linear material passes, to advantageously cause the linear material to be wrapped substantially uniformly around most of the surface area of the drum.

Several methods have been utilized in the past for achieving such reciprocating motion. One common approach is to use a rotating reversing screw which causes a guide to translate back and forth in front of a rotating drum. For example, such an approach is shown in U.S. Pat. No. 2,494,003 to Russ. However, such reversing screws tend to wear out quickly, degrading reel performance and necessitating frequent replacement. Further, such reversing screws are bulky and increase the size of the reel assembly.

Another approach for producing reciprocating motion of the guide is to use a motor to control a rotating screw upon which the guide translates. In this class of reels, the motor reverses the direction of rotation of the screw whenever the guide reaches an end of the screw. Unfortunately, the repeated reversing of the motor increases the spooling time and causes the motor to wear down sooner. Other reels have incorporated significantly more complicated gear mechanisms for achieving the reciprocating motion.

Many reel constructions include exposed moving parts, such as the reel drum, guide, and motor. Over time, such moving parts can become damaged due to exposure. For example, an outdoor reel is exposed to sunlight and rain. Such exposure can cause the moving parts of the reel to wear more rapidly, resulting in reduced performance quality.

Thus, there is a need for a compact reel assembly having a reel with an improved reciprocating mechanism for efficiently distributing linear material across the reel drum.

SUMMARY OF THE INVENTION

Accordingly, it is a principle object and advantage of the present invention to overcome some or all of these limitations and to provide an improved reel incorporating a reciprocating mechanism.

In accordance with one embodiment, a reciprocating mechanism is provided, comprising an element adapted to rotate about a first axis and a worm gear extending along the first axis and coupled with respect to the element. The reciprocating mechanism also comprises a driven gear meshingly engaged with the worm gear, the driven gear configured to rotate about a driven gear axis. A lever is coupled to and configured to rotate along with the driven gear about the driven gear axis, the lever having an elongated slot. A guide member defines an encircling slot in a plane generally parallel to a plane within which the lever rotates. An elongate member has a portion extending completely or partially through, and adapted to move along, the elongated slot of the lever, the elongate member portion also extending completely or partially through, and adapted to move along, the encircling slot of the guide member. The elongate member is pivotably secured to a frame or housing such that the elongate member is configured to pivot about an axis generally perpendicular to the plane of the encircling slot. Rotation of the element about the first axis produces rotation of the worm gear about the first axis, the rotation of the worm gear producing rotation of the driven gear and the lever about the driven gear axis, the rotation of the lever guiding the portion of the elongate member along the encircling slot in order to reciprocatingly pivot the element relative to the frame or housing about a second axis generally transverse to the first axis.

In accordance with another embodiment, a reel assembly is provided. The reel assembly comprises a drum configured to rotate about a drum axis and to receive a linear material being wrapped around a spool surface of the drum as the drum rotates about the drum axis and a housing substantially enclosing the drum, a portion of the housing defining an aperture configured to receive the linear material therethrough. The reel assembly also comprises a reciprocating mechanism, comprising a lever operatively coupled with respect to the drum and defining an elongated slot. A guide member is disposed proximal the lever, the guide member defining an encircling slot. An elongate member has a portion extending completely or partially through the elongated slot of the lever and extending completely or partially through the encircling slot of the guide member, the elongate member being pivotably coupled with respect to the housing. The rotation of the drum about the drum axis rotates the lever, which in turn guides the elongate member portion along the encircling slot so as to reciprocatingly rotate the drum relative to the housing about a reciprocation axis generally transverse with respect to the drum axis.

In accordance with another embodiment, a reel assembly is provided, comprising a drum configured to rotate about a drum axis and to receive a linear material being wrapped around a spool surface of the drum as the drum rotates about the drum axis and a housing substantially enclosing the drum, a portion of the housing defining an aperture configured to receive the linear material therethrough. The reel assembly also comprises a reciprocating mechanism configured to produce relative reciprocating rotation between the drum and the housing about an axis generally orthogonal to the drum axis and at a generally constant angular velocity between endpoints of the reciprocation for a given drum rotating speed about the drum axis.

In accordance with still another embodiment, a method for spooling linear material is provided. The method comprises rotating a drum about a first axis at a first speed, reciprocatingly rotating the drum about a second axis generally perpendicular to the first axis at a generally constant second speed between endpoints of the reciprocation, and drawing linear material onto the drum, the linear material being spooled across a surface of the drum by the reciprocating rotation of the drum.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these aspects are intended to be within the scope of the invention herein disclosed. These and other aspects of the present invention will become readily apparent to those skilled in the art from the appended claims and from the following detailed description of the preferred embodiments having reference to the attached figures, the invention not being limited to any particular preferred embodiment(s) disclosed.

BRIEF DESCRIPTION OF THE DRAWINGS

These and other features, aspects and advantages of the present invention will now be described in connection with a preferred embodiment of the invention, in reference to the accompanying drawings. The illustrated embodiment, however, is merely an example and is not intended to limit the invention. The drawings include the following figures.

FIG. 9A is a top and front perspective view of the reel assembly of FIG. 1 illustrating one position in the reciprocating rotation of the drum.

FIG. 9B is a top and front perspective view of the reel assembly of FIG. 1 illustrating another position in the reciprocating rotation of the drum.

For ease of illustration, some of the drawings do not show certain elements of the described apparatus.

DETAILED DESCRIPTION OF THE PREFERRED EMBODIMENT

In the following detailed description, terms of orientation such as "top," "bottom," "upper," "lower," "front," "rear," and "end" are used herein to simplify the description of the context of the illustrated embodiments. Likewise, terms of sequence, such as "first" and "second," are used to simplify the description of the illustrated embodiments. Because other orientations and sequences are possible, however, the present invention should not be limited to the illustrated orientation. Those skilled in the art will appreciate that other orientations of the various components described above are possible.

Figure 1:
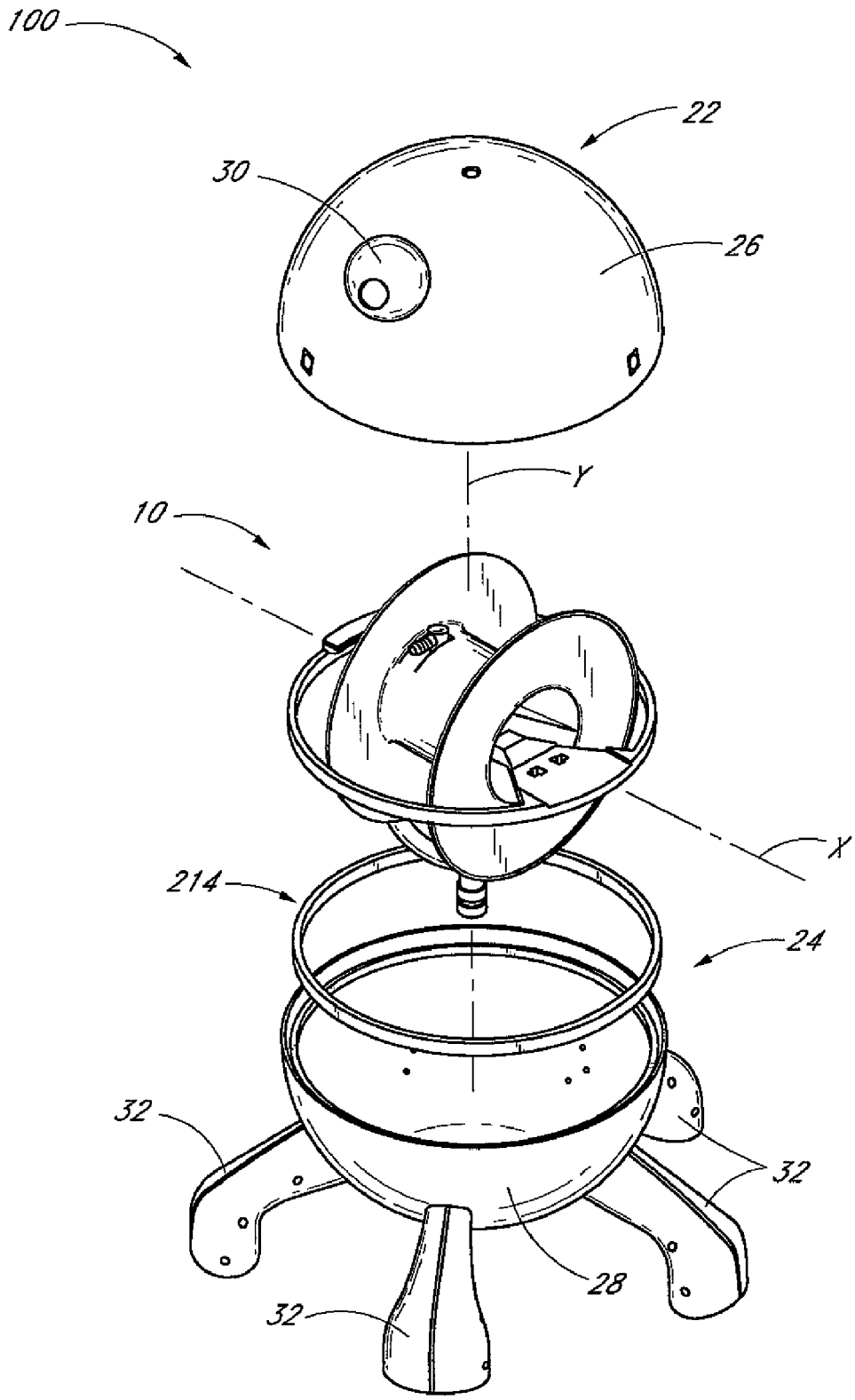
FIG. 1 is a front perspective view of a disassembled reel, including a housing, in accordance with one embodiment.

FIG. 1 illustrates one embodiment of a reel assembly 100 substantially enclosing a drum assembly 10 in a housing. In the illustrated embodiment, the housing includes an upper or top shell portion 22 and a lower or bottom shell portion 24. Additionally, the upper and lower shell portions 22, 24 have the shape of upper and lower domes 26, 28, respectively, so that the reel assembly 100 has a generally spherical shape. However, the upper and lower shell portions 22, 24 can have any suitable shape, such as cylindrical and aspherical. As shown in FIG. 1, the upper shell portion 22 includes a guide member 30 with an aperture (not shown), which preferably guides a linear material, such as a water hose, into and out of the housing of the reel assembly 100 as the linear material is wound onto or unwound from the drum assembly 10. Additionally, the lower shell portion 24 is preferably supported by a plurality of legs 32. However, other types of legs or support structures can be used. In one embodiment, a circumferential stand supports the lower shell portion 24 on a support surface. Preferably, the lower shell portion 24 is movably supported with respect to a lower support surface, so that the reel assembly 100 is capable of moving along the surface. For example, the legs 32 or support structure can have rollers.

Figure 2:
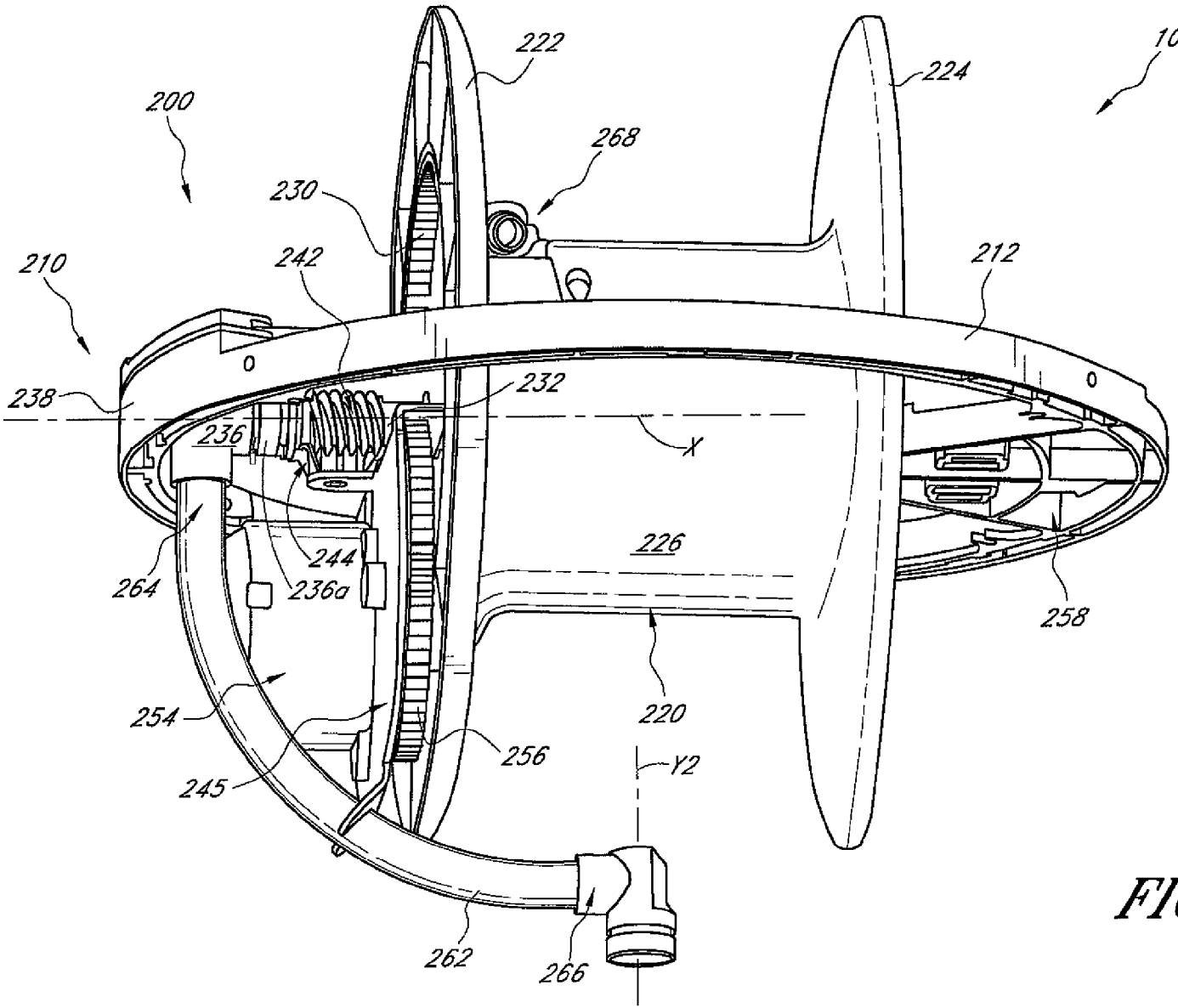
FIG. 2 is a bottom perspective view of a drum assembly with reciprocating mechanism, in accordance with one embodiment disclosed herein.

As seen in FIGS. 1 and 2, the drum assembly 10 defines a first or drum axis X about which the drum rotates. Additionally, a housing or second axis Y extends through the reel assembly 100. In a preferred embodiment, the housing axis Y is generally vertical and the drum axis X is generally horizontal, so that the housing axis Y is generally orthogonal to the drum axis X. Further details on reel assemblies can be found in U.S. Pat. No. 6,279,848, the entire contents of which are hereby incorporated by reference and should be considered a part of this specification.

FIGS. 2-7 illustrate one embodiment of a reciprocating mechanism 200 for a reel assembly. In one embodiment, the reciprocating mechanism 200 can be used with the reel assembly 100 illustrated in FIG. 1. The reciprocating mechanism 200 preferably includes a frame 210 comprising a top frame and a bottom frame. In the illustrated embodiment, the top frame includes an upper ring 212 and the bottom frame includes a lower ring 214 (see FIG. 1). In a preferred embodiment, the upper ring 212 is coextensive with and removably disposed on the lower ring 214. In another embodiment, the upper ring 212 overlaps the lower ring 214. The upper and lower rings 212, 214 are preferably fastened to the upper and lower shell portions 22, 24, respectively, via any suitable method. In one embodiment, the shell portions 22, 24 can be fastened to the rings 212, 214, respectively, using bolts or screws. In another embodiment, the shell portions 22, 24 can be clamped, welded, or adhesively secured to the rings 212, 214.

Figure 5:
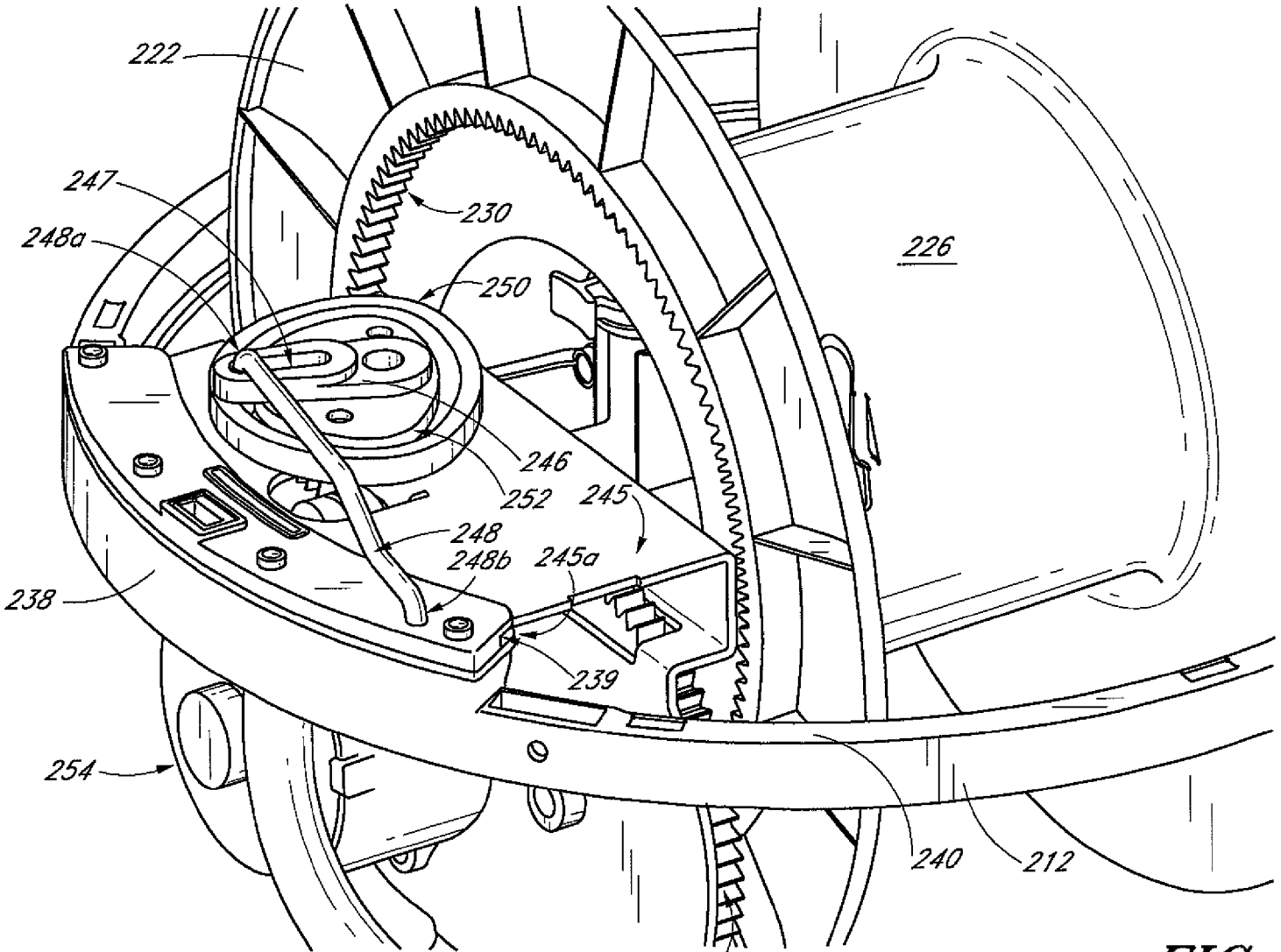
FIG. 5 is a top partially cut-away perspective view of the reciprocating mechanism shown in FIG. 2.

In a preferred embodiment, the upper ring 212 can rotate relative to the lower ring 214. For example, bearings (not shown) can be disposed between the upper and lower rings 212, 214. Preferably, the rings 212, 214 are sized to enclose a drum assembly 220, which consists of first and second endplates 222, 224 and a drum 226 disposed between the endplates 222, 224. As shown in FIGS. 2 and 5, a ring gear 230 is preferably attached to the first endplate 222.

Figure 3:
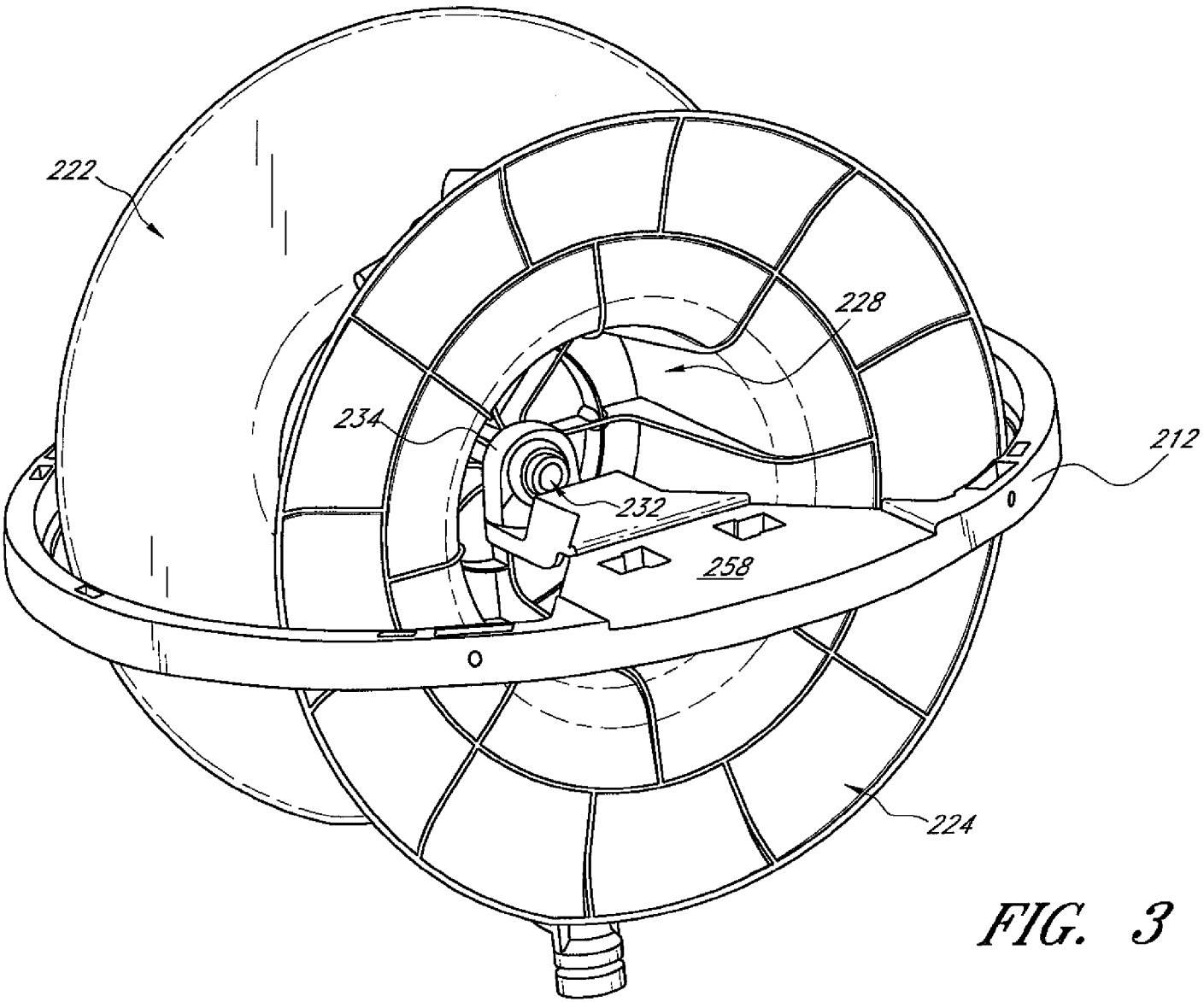
FIG. 3 is a top and side perspective view of one embodiment of a drum assembly.

The ring gear 230 is coupled to a shaft 232, which preferably extends into a hollow portion 228 of the drum 226 and rotatingly couples to a shaft support 234 disposed inside the hollow portion 228 (see FIG. 3). In one preferred embodiment, the shaft support 234 is disposed generally at the center of the upper ring 212. In another embodiment, the shaft support 234 can be offset from the center of the upper ring 212. Preferably, the shaft support 234 allows the shaft 232 to rotate freely therein. For example, in one embodiment, the shaft 232 can couple to the shaft support 234 via a bearing (not shown) disposed therein. As explained more fully below, the shaft 232 is preferably hollow so as to convey water. Additionally, the connection between the shaft 232 and the shaft support 234 preferably inhibits the leakage of fluid therebetween, as further discussed below. For example, in one embodiment, the connection between the shaft 232 and the shaft 234 includes a substantially water-tight seal.

The shaft 232 also connects to a fitting 236. The fitting 236 couples to a conduit member 262 disposed within the lower shell portion 24 and disposed below the lower ring 214. In the illustrated embodiment, the conduit member 262 is curved and has a first end 264 that connects to the fitting 236, which in turn connects to the shaft 232. The conduit member 262 has a second end 266 disposed generally along an axis Y2 extending generally perpendicular to the upper and lower rings 212, 214. In one embodiment, the shell axis Y and the axis Y2 are coaxial. Preferably, the second end 266 extends through an aperture (not shown) in the lower shell portion 24. In one preferred embodiment, the fitting 236 is not coupled to the upper ring 212. Further description of the fitting 236 and the conduit member 262 is provided below.

As shown in FIG. 5, an upper ring support member 238 extends from a surface 240 of the upper ring 212. In the illustrated embodiment, the upper ring support member 238 defines a slot 239 therein. Preferably, the slot 239 extends along the length of the support member 238 and is sized to slidingly receive one end 245*a* of a support frame 245 coupled to the conduit member 262. As shown in FIG. 5, the support frame 245 has a horizontal portion and a vertical portion, and the end 245*a* extends from the horizontal portion of the support frame 245. In one embodiment, at least one bearing (not shown) is disposed in the slot 239 to facilitate the sliding of the end 245*a* of the support frame 245 relative to the slot 239. However, other suitable methods for facilitating the sliding of the support frame 245 in the slot 239, such as, for example, applying a lubricant to at least one of the slot 239 and the end 245*a* of the support frame 245.

Preferably, the shaft 232 includes a worm gear section 242, which extends along at least a portion of the shaft 232. In one embodiment, the worm gear section 242 extends along substantially the entire length of the shaft 232. The shaft 232 is preferably integrally formed with the worm gear section 242. In another embodiment, the shaft 232 is removably coupled to the worm gear section 242 via, for example, a spline connection.

Figure 6:
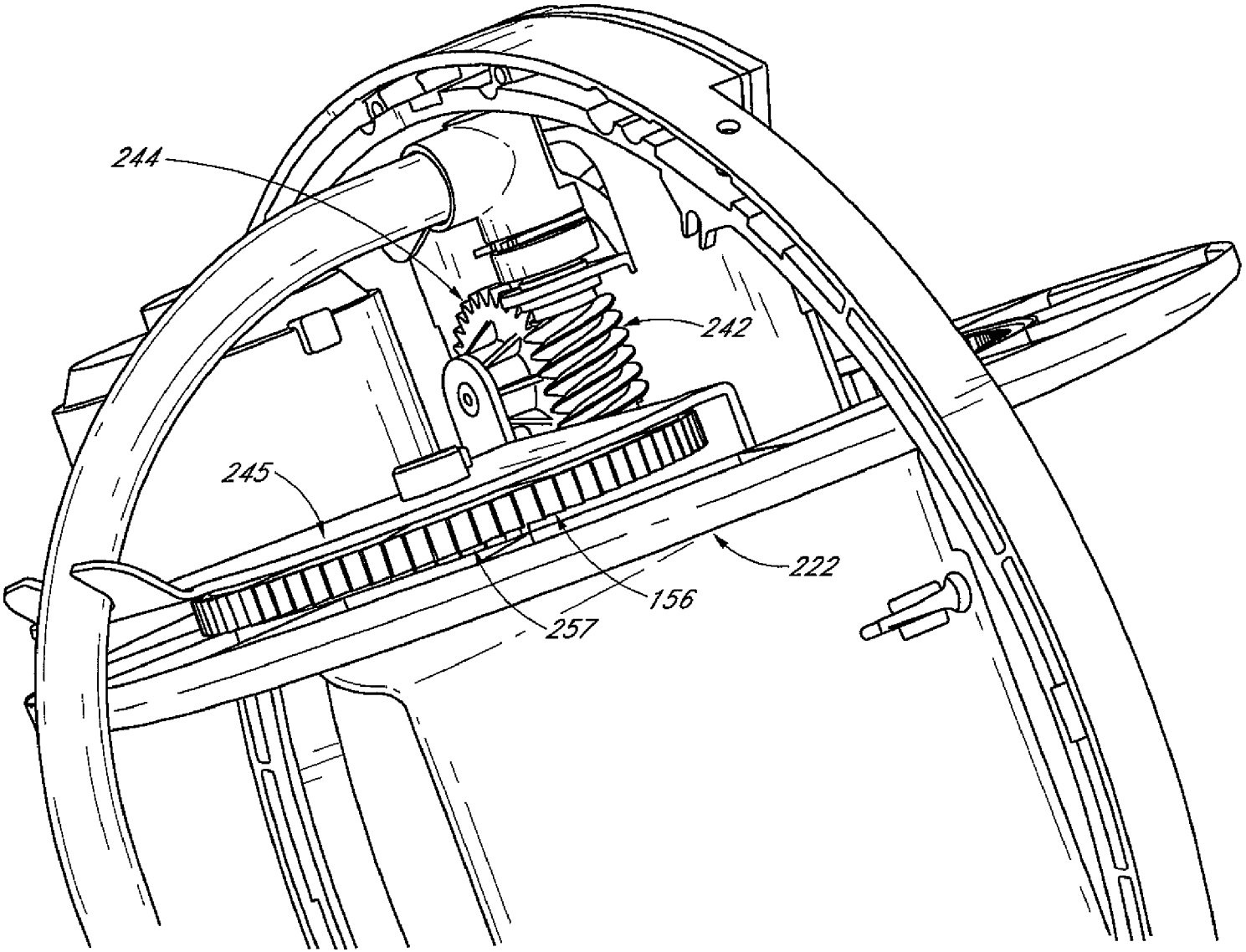
FIG. 6 is a bottom partially cut-away view of the reciprocating mechanism for a reel shown in FIG. 2.
Figure 7:
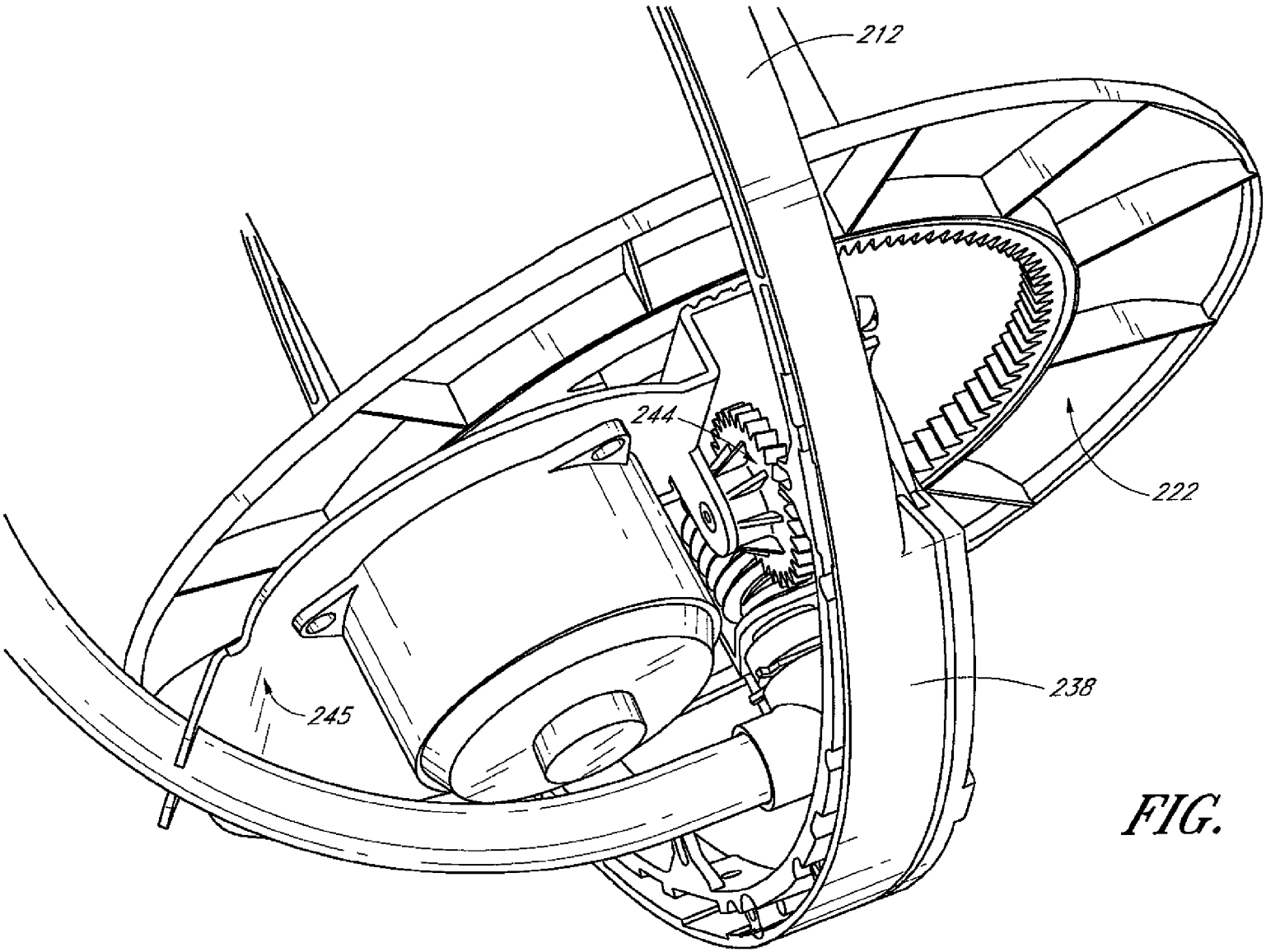
FIG. 7 is a bottom and side partially cut-away perspective view of reciprocating mechanism of FIG. 2.

As shown in FIGS. 2, 6 and 7, the worm gear section 242 preferably meshingly engages a top or driven gear 244 mounted on and below the support frame 245. As used herein, the "engagement" of two gears means that the teeth of one gear are engaged with the teeth of the other gear. The top gear 244 is in turn coupled to a lever 246 (see FIG. 5), for example, via a pin 246*a* (see FIG. 8B) that extends along an axis of rotation of the top gear 244. As shown in FIG. 5, the lever 246 defines an elongated slot 247 therein. In a preferred embodiment, the top gear 244 and lever 246 are lockingly coupled, so that rotation of the top gear 244 results in rotation of the lever 246. In another embodiment, the top gear 244 and lever 246 are integrally formed. The lever 246 is preferably coupled to an elongate member 248, so that a first end or portion 248*a* of the elongate member 248 extends through and is adapted to slidingly move along the slot 247, while a second end or portion 248*b* of the elongate member 248 is pivotably secured to the support member 238. In one embodiment, the first end 248*a* of the elongate member 248 extends completely through the slot 247 of the lever 246 and at least partially or completely through the slot 252 of the guide member 250 (described below). In another embodiment, the lever 246 is below the guide member 250, and the first end 248*a* of the elongate member 248 extends completely through the slot 252 and at least partially or completely through the slot 247 of the lever 246.

As best shown in FIG. 5, a guide member or track 250 is disposed adjacent the lever 246, so that the guide member 250 extends along a plane generally parallel to a plane within which the lever 246 rotates. In the illustrated embodiment, the guide member 250 defines an encircling slot 252. In the illustrated embodiment, the enclircling slot 252 extends only partially through the guide member 250, so as to define a groove or recess. In another embodiment, the encircling slot 252 can extend completely through the guide member 250. In the illustrated embodiment, the first end 248*a* of the elongate member 248 extends partially through and is adapted to move along the encircling slot 252 of the guide member 250, so that the elongate member 248 pivots about an axis generally perpendicular to the plane of the encircling slot 252. In another embodiment, the first end 248*a* of the elongate member 248 can extend completely through the encircling slot 252 of the guide member 150. In the illustrated embodiment, the guide member 250 is disposed between the support frame 245 and the lever 246 and is preferably secured to the support frame 245. However, in another embodiment, the lever 246 can be positioned between the support frame 245 and the guide member 250. As used herein, encircling means surrounding, but is not necessarily limited to a circular surrounding. In the illustrated embodiment, the guide member 250 is shaped somewhat in the form of a "D" (see FIG. 8A). However, the guide member 250 can have other suitable shapes, such as circular, oval, triangular and trapezoidal.

Figure 2A:
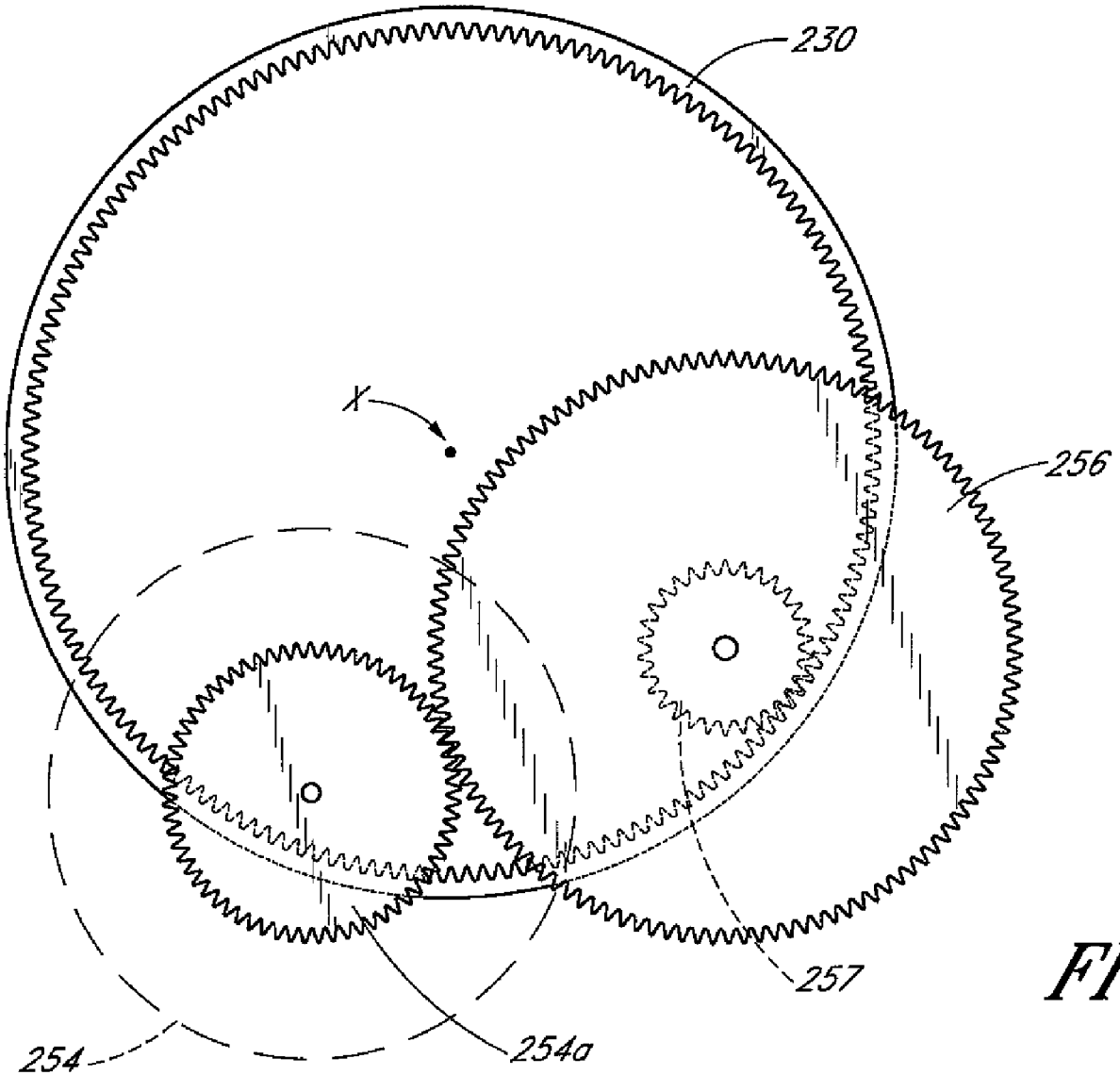
FIG. 2A is a schematic illustration of a gear reduction between a motor and a gear of the reciprocating mechanism shown in FIG. 2.

As shown, for example in FIG. 2, the reciprocating mechanism 200 includes a motor 254 mounted to the support frame 245. In the illustrated embodiment, the motor 254 is disposed below the lower ring 214 and is housed in the lower shell portion 24. Preferably, the motor 254 is an electric motor. The motor 254 preferably operatively connects to the ring gear 230 via a drive gear 256. For example, the motor 254 can, through a gear reduction comprising multiple gears, drive the drive gear 256, which can operatively drive the ring gear 230 at a desired speed. One example of a gear reduction is shown in FIG. 2A, which includes a motor gear 254*a* that meshingly engages and drives the drive gear 256. In the illustrated embodiment, another gear 257 (also shown in FIG. 6), which is preferably co-axial with the drive gear 256, meshingly engages and drives the ring gear 230. However, the gear reduction can include any number of gears and have other configurations for operatively coupling the motor 254 to the ring gear 230. Additionally, any desired gear ratio can be used. In one embodiment, the gear reduction has a gear ratio of 2 to 1. In another embodiment, the gear reduction has a gear ratio of 4 to 1. In still another embodiment, the gear reduction has a gear ratio of between about 2 to 1 and about 25 to 1. One example of a gear reduction between the motor 254 and the ring gear 230 is schematically shown in FIG. 2A.

The reel 100 can also employ an electronic motor controller and associated electronic componentry for controlling the speed and direction of the motor 254. For example, while spooling the linear material 268 (see FIG. 9A) onto the drum 226, a motor-controller can be employed to vary the motor speed based upon the length of unwound linear material 268. It will be appreciated that if the motor speed is constant, the inwardly pulled linear material 268 tends to move increasingly faster due to the increasing diameter of the spool itself. A motor-controller can adjust the motor speed to more safely control the motion of the linear material 268 during spooling. Also, a motor-controller can be used to slow or stop the motor 254 just before the linear material 268 becomes completely spooled onto the drum 226. Otherwise, the linear material 268 would get pulled into the housing or, if there is an object at the end of the linear material 268 (e.g., a nozzle), the object may whip against or otherwise impact the housing or a person near the housing. In addition, a motor-controller can even be used to assist the user during unspooling of the linear material 268 (i.e., powered unspooling). One example of a motor-controller for a reel is disclosed in U.S. Pat. No. 7,350,736 to Caamaño et al., entitled Systems and Methods for Controlling Spooling of Linear Material, the entire contents of which are hereby incorporated by reference and should be considered a part of this specification. Also, the motor 254 and/or motor-controller can be operated via a remote control. An exemplary remote control system for a motorized reel is disclosed in U.S. Patent Publication No. US 2004-0231723 A1, the entire contents of which are hereby incorporated by reference and should be considered a part of this specification. In a preferred embodiment, a remote control is engaged on the spooled linear material 268 at or near its outward end. The remote control can send signals wirelessly (e.g., via radio frequency signals) or through a wire within the linear material.

Figure 4:
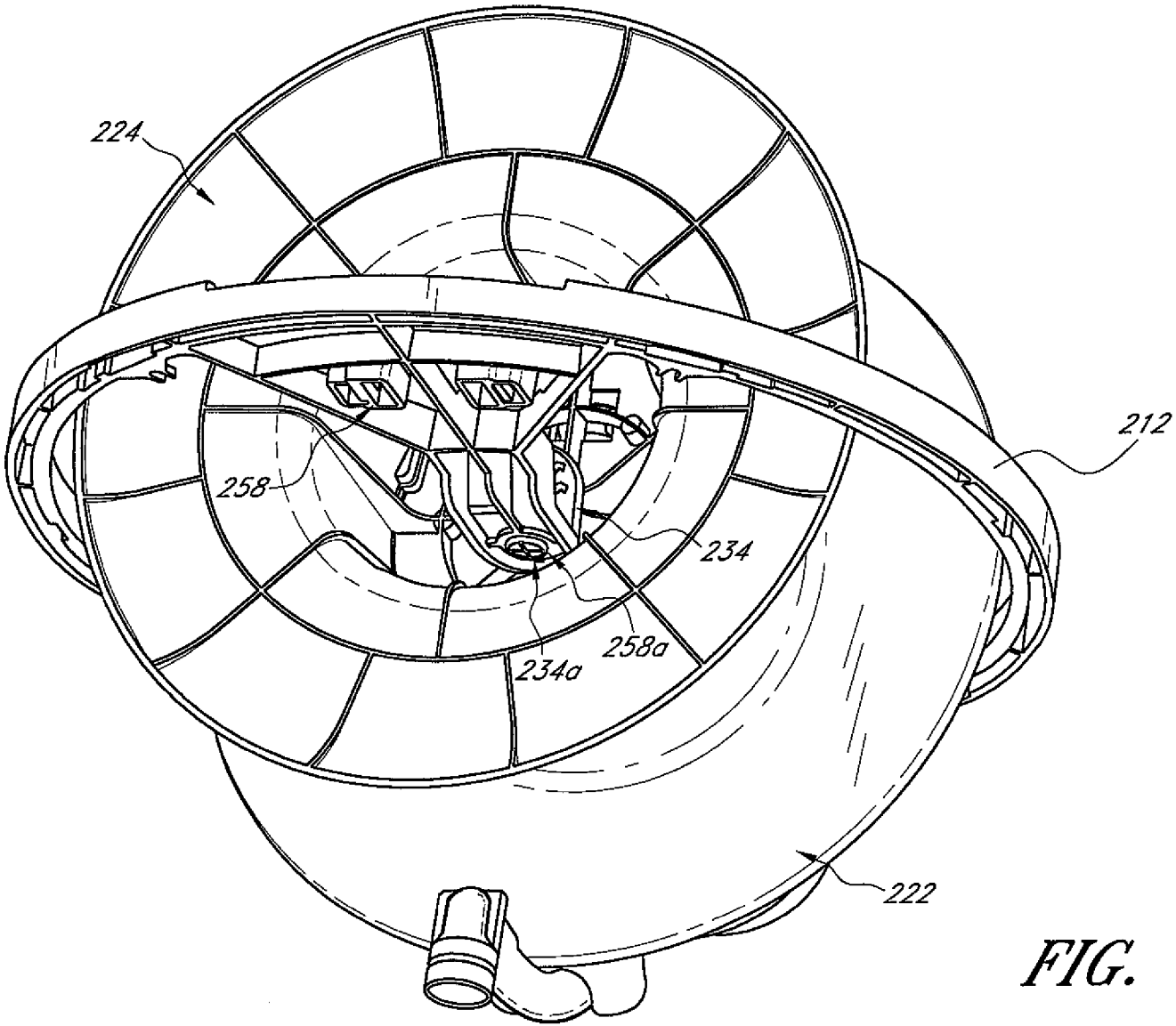
FIG. 4 is bottom and side perspective view of the drum assembly in FIG. 3.
Figure 8A:
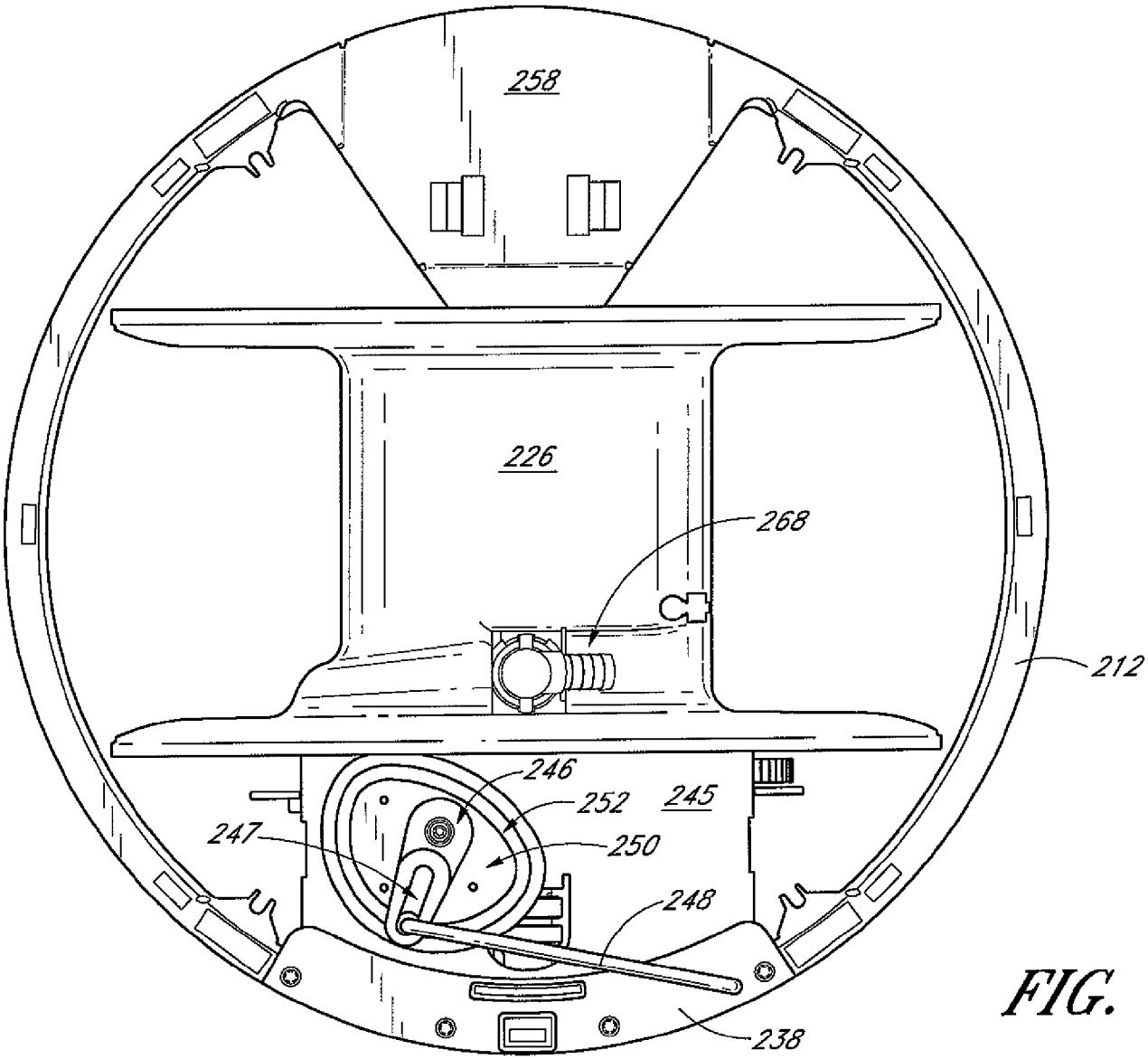
FIG. 8A is a top view of the drum assembly of FIG. 2 illustrating one position in the reciprocating rotation of the drum.
Figure 8B:
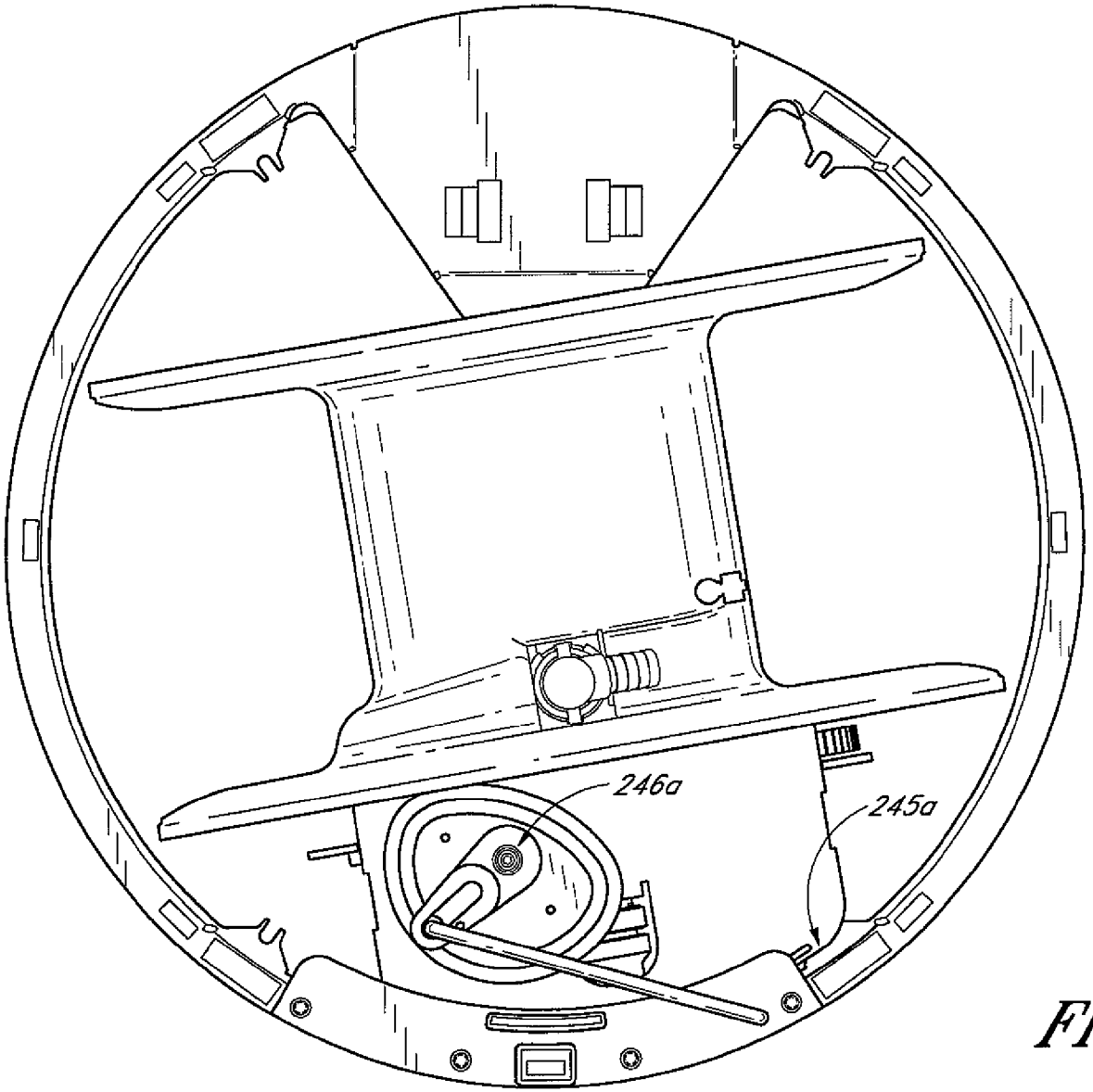
FIG. 8B is a top view of the drum assembly of FIG. 2 illustrating another position in the reciprocating rotation of the drum.
Figure 8C:
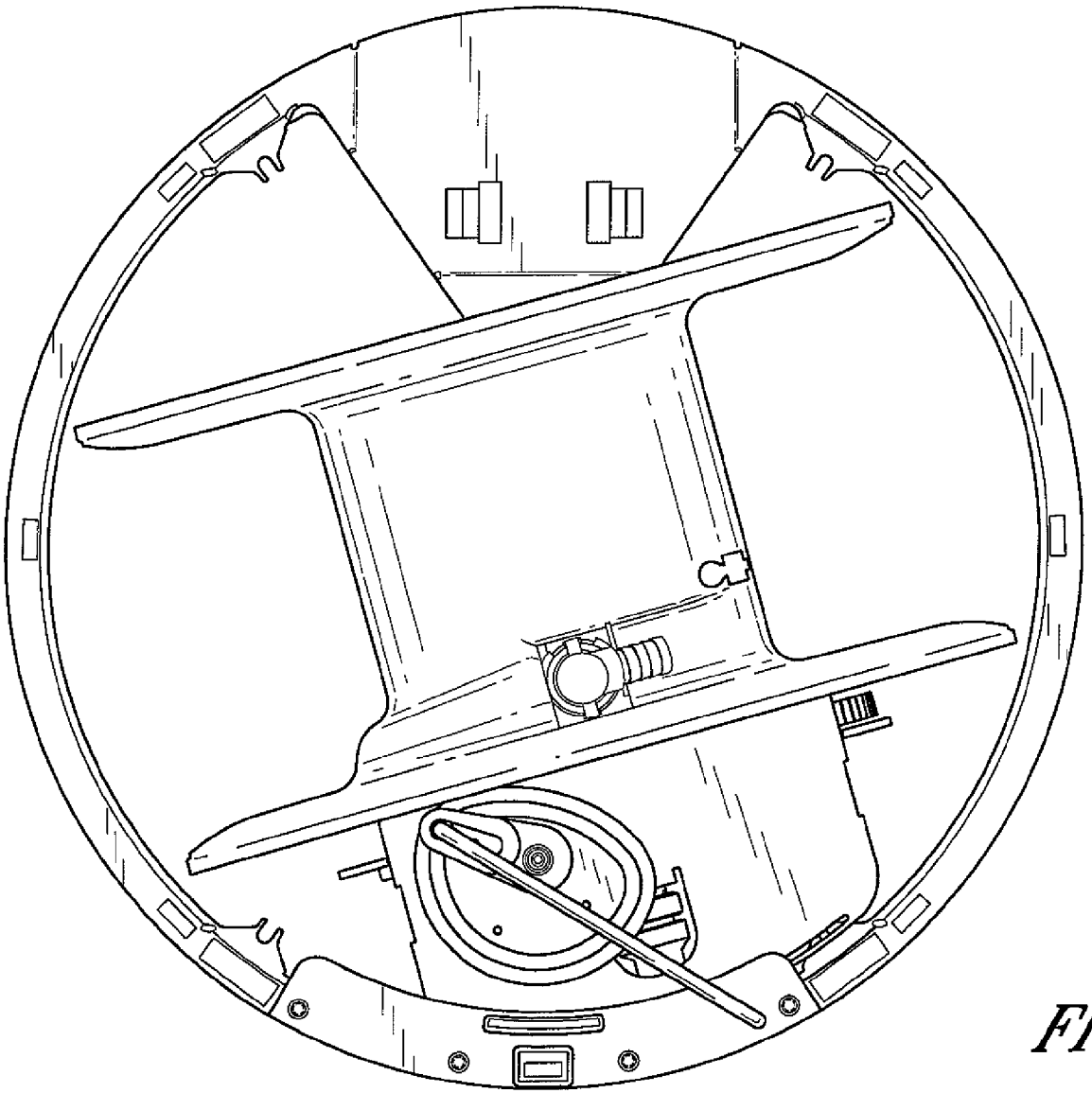
FIG. 8C is a top view of the drum assembly of FIG. 2 illustrating another position in the reciprocating rotation of the drum.
Figure 8D:
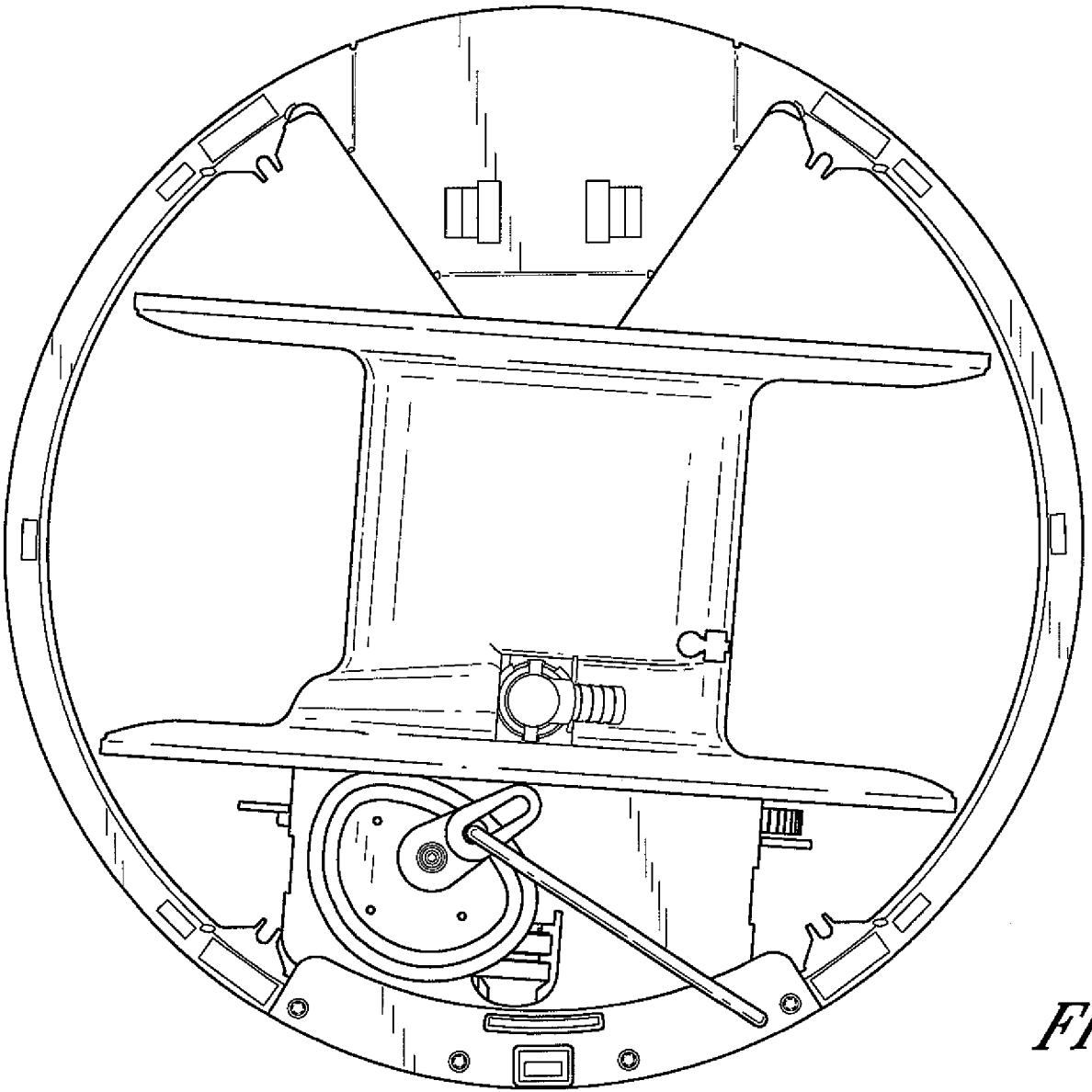
FIG. 8D is a top view of the drum assembly of FIG. 2 illustrating another position in the reciprocating rotation of the drum.
Figure 8E:
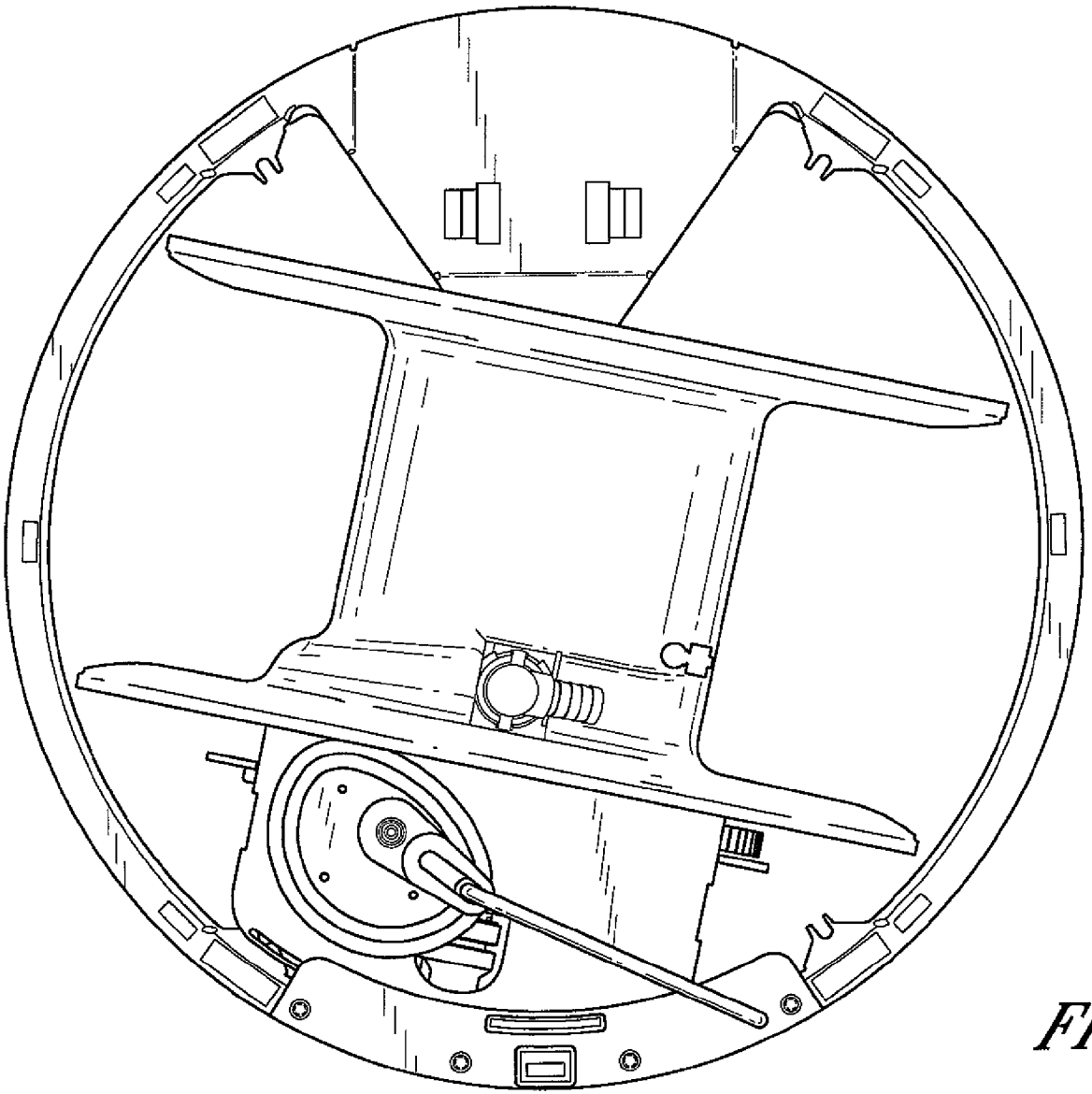
FIG. 8E is a top view of the drum assembly of FIG. 2 illustrating another position in the reciprocating rotation of the drum.

As shown in FIGS. 3-4, the reciprocating mechanism 200 also has a platform 258 that extends between the shaft support 234 and the edge of the upper ring 212. As shown in FIG. 8A, the platform 258 is disposed generally opposite the upper ring support member 238. The platform 258 preferably extends into the hollow portion 228 of the drum 226. In one embodiment, the platform 258 can support a battery (not shown) thereon so that the battery is disposed between the second endplate 224 and the upper ring 212. Preferably, the battery provides power to the motor 254. Details of one suitable battery for use with the reciprocating mechanism 200 can be found in U.S. Pat. No. 7,320,843 to Harrington, entitled Battery Assembly With Shielded Terminals, the entire contents of which are hereby incorporated by reference and should be considered a part of this specification.

As shown in FIGS. 3 and 4, the platform 258 preferably supports the shaft support 234 thereon. In the illustrated embodiment, a pin 234*a* of the shaft support 234 pivotably extends through an opening 258*a* of the platform 258, permitting the shaft support 234 to rotate with respect to the platform 258 about a vertical axis extending through the opening 258*a*. This pivot connection advantageously allows the reciprocating mechanism 200 to reciprocatingly rotate the drum 226 about the shell axis Y, as further discussed below.

As discussed above, the fitting 236 couples to the conduit member 262. In one embodiment, the second end 266 of the conduit 262 is configured to removably attach to a water hose (not shown). For example, the second end 266 can have a threaded surface for threaded engagement with a corresponding thread on the hose (e.g., a standard hose fitting). In another embodiment, the second end 266 can have a quick-disconnect portion configured to removably engage a corresponding quick-disconnect portion on the hose. Other mechanisms for connecting the hose and the conduit 262 are also possible. Preferably, water provided through the hose flows through the conduit 262 and through the fitting 236 and shaft 232 into the shaft support 234. In one preferred embodiment, the shaft support 234 communicates, for example, via a second conduit (not shown), with a second fitting 268 (see FIGS. 2 and 8A) disposed on the surface of the drum 226. In this manner, water can be supplied to a hose that has been spooled on the drum 226 and has been removably fastened to the second fitting 268. Any suitable mechanism for removably fastening the hose and the second fitting 268 can be used, such as a threaded engagement or a quick-disconnect connection. Further details on such an arrangement is shown, for example, in U.S. Pat. No. 6,981,670 to Harrington, entitled Reel Having Apparatus for Improved Connection of Linear Material, the entire contents of which are hereby incorporated by reference and should be considered a part of this specification.

The rings 212, 214 and gears 230, 242, 244, 256 of the reciprocating mechanism 200 are preferably made of a strong material resistant to breaking. In one embodiment, the rings 212, 214 and gears, 230, 242, 244, 256 can be made of a metal or metal alloy, such as stainless steel and aluminum. However, other materials can also be used. In another embodiment, the rings 212, 214 and gears 230, 242, 244, 256 of the reciprocating mechanism 200 can be made of a hard plastic. In still another embodiment, the gears 230, 242, 244, 256 may be formed of acetyl, such as Delrin® sold by Dupont, headquartered in Wilmington, Del. Various combinations of these materials are also possible.

The use of the reciprocating mechanism 200 to reciprocatingly rotate the drum assembly 220 is illustrated in FIGS. 8A-8E. Actuation of the motor 254 preferably rotates the ring gear 230 in one direction via the drive gear 256 and, optionally, a gear reduction assembly (see e.g., FIG. 2A) operatingly coupling the motor 254 to the drive gear 256. Rotation of the ring gear 230 in turn rotates the reel drum 226 via the first endplate 222. Rotation of the ring gear 230 also rotates the shaft 232 in the same direction, causing the worm gear section 242 to also rotate. Rotation of the worm gear section 242 rotates the top or driven gear 244, which in turn rotates the lever 246 about the axis of the top gear 244. As the lever 246 rotates, it guides the first end 248*a* of the elongate member 248 about the axis of the top gear 244 and along the encircling slot 252 of the guide member 250, thus moving the elongate member back and forth. As the lever 246 rotates and guides the first end 248*a* of the elongate member 248 about the axis of the top gear 244, the first end 248*a* also slides along the slot 247 of the lever 246. The movement of the elongate member 248 in turn reciprocatingly rotates the drum 226 relative to the upper ring 212 about the shell axis Y via the pivot connection 234*a*, 258*a* between the shaft support 234 and the platform 258. In one embodiment (e.g., if the slot 252 is circular), the reciprocating mechanism 200 reciprocatingly rotates the drum 226 so that an angular velocity of the drum about the shell axis Y fluctuates generally sinusoidally.

In a preferred embodiment, the slot 247 on the lever 246 and the encircling slot 252 on the guide member 250 allow the drum 226 to reciprocate about the shell axis Y at a generally constant angular velocity between endpoints of the reciprocation for a given drum 226 rotation speed about the drum axis X. It is the general D-shape of the slot 252 that produces this outcome. It will be appreciated that other sizes and shapes of the slot 252, slot 247, lever 246, and elongate member 248 can achieve the goal of a generally constant angular velocity between endpoints of the reciprocation.

In one embodiment, the upper shell portion 22, which is preferably fixed with respect to the upper ring 212, and the aperture guide 30 in the upper shell portion 22, remain in a fixed position while the drum 226 reciprocatingly rotates inside the housing to spool and unspool the linear material 268, as shown in FIGS. 9A-9B. In another embodiment, the reciprocating mechanism 200 reciprocatingly rotates the upper shell portion 22 about the shell axis Y, while the drum 226 is preferably in a substantially fixed angular position.

The substantially constant angular velocity of the drum 226 about the shell axis Y that is generated by the reciprocating mechanism 200 advantageously allows the spooling and unspooling of linear material onto the drum 226 with increased efficiency. Such increased efficiency allows the use of a drum 226 having a smaller width to spool the same amount of linear material, requires less power to spool the same amount of linear material, and allows for an overall reduction in the size of the reel assembly 100. The reciprocating mechanism 200 according the embodiments discussed above also advantageously require about 30% less parts to operate than conventional reciprocating mechanisms.

Figure 10:
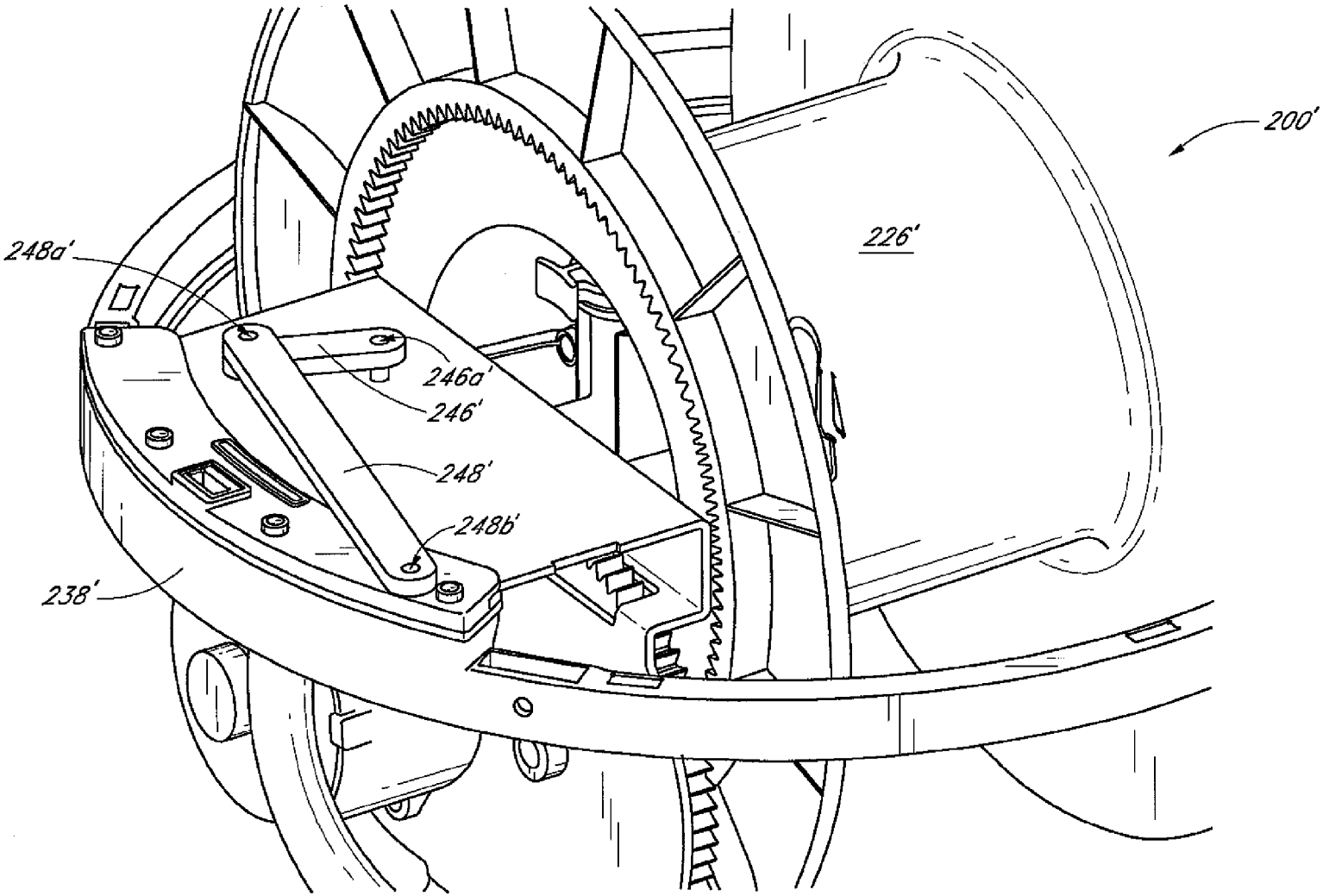
FIG. 10 is a top partially cut-away perspective view of another embodiment of a reciprocating mechanism.

FIG. 10 illustrates another embodiment of a reciprocating mechanism 200'. The reciprocating mechanism 200' is similar to the reciprocating mechanism 200, except as noted below. Thus, the reference numerals used to designate the various components of the reciprocating mechanism 200' are identical to those used for identifying the corresponding components of the reciprocating mechanism 200 in FIG. 5, except that a "'" has been added to the reference numerals.

The reciprocating mechanism 200' includes a top or driven gear coupled to a lever 246' via a pin 246*a*' that extends along the axis of the top gear. The top gear and the lever 246' are preferably lockingly coupled, so that rotation of the top gear about the top gear axis results in rotation of the lever 246' in the same direction. In another embodiment, the top gear and the lever 246' can be integrally formed. The lever 246' is preferably pivotably coupled to an elongate member 248' at a first pivot point 248*a*'. The elongate member 248' is also pivotably secured to a support member 238' at a second pivot point 248*b*'. The relative motion between the lever 246' and the elongate member 248' advantageously generates a reciprocating motion of the drum 226' about a drum axis.

In a preferred embodiment, the gear ratio of the gear reduction and size of the ring gear 230, worm gear 242, drive gear 256, and top gear 244, as well as the lengths of the levers 246 and elongate member 248, are selected to reciprocatingly rotate the drum 226 relative to the upper ring 212 about the shell axis Y so as to cause a linear material to be generally uniformly wound onto the reel drum. Thus, the reciprocating mechanism 200 advantageously allows a linear material to be uniformly wound onto the drum 226.

As discussed above, the upper ring 212 and drum assembly 220 preferably rotate freely relative to the lower ring 214, preferably through 360 degrees and more, as desired. Therefore, the upper shell portion 22 coupled to the upper ring 212 can advantageously rotate freely relative to the lower shell portion 24, which is preferably fixed with respect to the lower ring 214.

Of course, the foregoing description is that of certain features, aspects and advantages of the present invention, to which various changes and modifications can be made without departing from the spirit and scope of the present invention. Moreover, the reciprocating mechanism for a reel assembly need not feature all of the objects, advantages, features and aspects discussed above. Thus, for example, those skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed reciprocating mechanism for a reel assembly.

What is claimed is:

1. A reel assembly, comprising:

a rotatable element configured to rotate about a spooling axis and to receive a linear material being wrapped around a spool surface of the rotatable element as the rotatable element rotates about the spooling axis;

a housing substantially enclosing the rotatable element, a portion of the housing defining an aperture configured to receive the linear material therethrough; and a reciprocating mechanism provided with a slot member having an elongated slot, a guide member having an encircling slot, and an elongate member pivotally connected to said housing and interacting with said elongated slot and said encircling slot to produce relative reciprocating rotation between the rotatable element and the housing about an axis generally orthogonal to the spooling axis and at a generally constant angular velocity between endpoints of the reciprocation for a given rotatable element rotating speed about the spooling axis.

2. The reel assembly of claim 1, wherein the reciprocating mechanism is disposed between a plate of the rotatable element and the housing.

3. A reciprocating mechanism, comprising:

an element adapted to rotate about a first axis;

a worm gear extending along the first axis and coupled with respect to the element;

a driven gear meshingly engaged with the worm gear, the driven gear configured to rotate about a driven gear axis;

a slot member coupled to and configured to rotate along with the driven gear about the driven gear axis, the slot member having an elongated slot;

a guide member defining an encircling slot in a plane generally parallel to a plane within which the slot member rotates; and an elongate member having a portion extending completely or partially through, and adapted to move along, the elongated slot of the slot member, the elongate member portion also extending completely or partially through, and adapted to move along, the encircling slot of the guide member, the elongate member being pivotably secured to a frame or housing such that the elongate member is configured to pivot about an axis generally perpendicular to the plane of the encircling slot;

wherein rotation of the element about the first axis produces rotation of the worm gear about the first axis, the rotation of the worm gear producing rotation of the driven gear and the slot member about the driven gear axis, the rotation of the slot member guiding the portion of the elongate member along the encircling slot in order to reciprocatingly pivot the element relative to the frame or housing about a second axis generally transverse to the first axis.

4. The reciprocating mechanism of claim 3, further comprising:

a ring gear fixed with respect to the element;

a drive gear meshingly engaged with the ring gear; and a motor operatively coupled with respect to the drive gear and configured to rotate the drive gear, which in turn rotates the ring gear and the element about the first axis.

5. The reciprocating mechanism of claim 4, further comprising a gear reduction that couples the motor to the drive gear.

6. The reciprocating mechanism of claim 3, forming a part of a reel for spooling and unspooling linear material.

7. The reciprocating mechanism of claim 3, wherein the element comprises a plate that rotates along with a reel drum configured to receive a linear material thereabout, the reel drum and the plate configured to rotate together about the first axis.

8. The reciprocating mechanism of claim 7, wherein the frame or housing comprises a housing that substantially encloses the plate and the reel drum, at least a portion of the housing configured to be stationary while the plate and reel drum reciprocatingly rotate about the second axis, the portion of the housing having a guide aperture configured to guide the linear material therethrough onto a spool surface of the reel drum.

9. The reciprocating mechanism of claim 3, wherein the encircling slot generally has a "D" shape.

10. The reciprocating mechanism of claim 3, wherein the encircling slot extends only partially through the guide member.

11. A reel assembly, comprising:

a rotatable element configured to rotate about a spooling axis and to receive a linear material being wrapped around a spool surface of the rotatable element as the rotatable element rotates about the spooling axis;

a housing substantially enclosing the rotatable element, a portion of the housing defining an aperture configured to receive the linear material therethrough; and a reciprocating mechanism comprising:

a slot member operatively coupled with respect to the rotatable element and defining an elongated slot, a guide member disposed proximal the slot member, the guide member defining an encircling slot, and an elongate member having a portion extending completely or partially through the elongated slot of the slot member and extending completely or partially through the encircling slot of the guide member, the elongate member being pivotably coupled with respect to the housing, wherein the rotation of the rotatable element about the spooling axis rotates the slot member, which in turn guides the elongate member portion along the encircling slot so as to reciprocatingly rotate the rotatable element relative to the housing about a reciprocation axis generally transverse with respect to the spooling axis.

12. The reel assembly of claim 11, wherein the reciprocating mechanism reciprocatingly rotates the rotatable element so that an angular velocity of the rotatable element about the reciprocation axis is generally sinusoidal.

13. The reel assembly of claim 11, wherein the reciprocating mechanism reciprocatingly rotates the rotatable element about the reciprocation axis at a substantially constant angular speed between endpoints of the reciprocation for a given rotatable element rotating speed about the spooling axis.

14. The reel assembly of claim 11, wherein the housing includes a top shell portion and a bottom shell portion, each of the top and bottom shell portions having a generally hemispherical shape.

15. The reel assembly of claim 14, wherein the housing includes a top frame and a bottom frame, the top shell portion being fixed with respect to the top frame and the bottom shell portion being fixed with respect to the bottom frame.

16. The reel assembly of claim 14, wherein the top shell portion and the rotatable element are configured to rotate relative to the bottom shell portion about the reciprocation axis.

17. The reel assembly of claim 11, wherein the reciprocating mechanism further comprises:

a ring gear disposed on an end plate of the rotatable element;

a worm gear extending along the spooling axis and coupled with respect to the rotatable element;

a drive gear meshingly engaged with the ring gear;

a motor operatively coupled with respect to the drive gear, the motor configured to rotate the drive gear; and a top gear meshingly engaged with the worm gear, wherein the top gear is coupled to the slot member, the top gear and the slot member configured to rotate about an axis generally orthogonal to the spooling axis, and wherein the rotation of the drive gear rotates the ring gear and the rotatable element, the rotation of the rotatable element rotates the worm gear and the rotation of the worm gear rotates the top gear to generate a reciprocating motion of the rotatable element about the reciprocation axis relative to the housing.

18. A method for spooling linear material, comprising:

rotating a rotatable element about a first axis at a first speed;

reciprocatingly rotating the rotatable element about a second axis generally perpendicular to the first axis at a generally constant speed between endpoints of the reciprocation; and drawing linear material onto the rotatable element, the linear material being spooled across a surface of the rotatable element by the reciprocating rotation of the rotatable element;

wherein rotating the rotatable element about the first axis includes converting the rotatable element rotation about the first axis into the reciprocating rotation of the rotatable element about the second axis;

wherein converting the rotatable element rotation comprises:

rotating a worm gear about the first axis, the worm gear extending along the first axis and coupled with respect to the rotatable element;

rotating a top gear in meshed engagement with the worm gear; and rotating a slot member coupled to the top gear about an axis of the top gear;

wherein rotation of the slot member guides an elongate member along an encircling slot of a guide member to generate the reciprocating rotation of the rotatable element.

* * * * *